United States Patent [19]

Karas

[11] 4,327,358

[45] Apr. 27, 1982

[54] PHYSICAL DETERRENT BARRIER WITH UPWARD LOOKING DETECTION SENSOR FOR INTRUDER DETECTION SYSTEM

[75] Inventor: Nicholas V. Karas, Lowell, Mass.

[73] Assignee: The United States of America as represented by the Secretary of the Air Force, Washington, D.C.

[21] Appl. No.: 126,073

[22] Filed: Feb. 29, 1980

[51] Int. Cl.[3] ..... G08B 13/18; H01P 3/10

[52] U.S. Cl. ..... 340/541; 340/564; 340/565; 333/237; 343/771; 343/5 PD

[58] Field of Search ..... 340/541, 540, 564–567, 340/550–554, 561; 343/770, 771, 760, 762, 5 P.D., 18 C; 333/237

[56] References Cited

U.S. PATENT DOCUMENTS 3,560,970 2/1971 Kamimura et al. ..... 343/771

FOREIGN PATENT DOCUMENTS 1289513 9/1972 United Kingdom ..... 340/564

OTHER PUBLICATIONS

"Perimeter protection with microwaves", A. D. Woods, JST Charters, Microwave System News, vol. 6, No. 4, pp 113–114, 117–118 Sep. 1976.

"Reflector Type Antennas", J. D. Kram, McGraw Hill, 1950 pp 326–336.

*Primary Examiner*—John W. Caldwell, Sr.

*Assistant Examiner*—Donnie L. Crosland

*Attorney, Agent, or Firm*—Donald J. Singer; Willard R. Matthews, Jr.

[57] ABSTRACT

A physical deterrent barrier is utilized as an integral part of an intruder detection sensor that provides surveillance of intrusions in the air space over the barrier. The sensor is a corner reflecting antenna that is coextensive with and mounts on the top of the barrier and is integrated into a barbed wire topped chain link fence by arranging appropriately spaced parallel strands of barbed wire into a V configuration so as to effect an electrical corner reflector at the system operating frequency.

5 Claims, 9 Drawing Figures

PHYSICAL DETERRENT BARRIER WITH UPWARD LOOKING DETECTION SENSOR FOR INTRUDER DETECTION SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to systems for the protection of secure areas, and to intruder detection systems. Specifically, it relates to an intruder detecting sensing device that can be integrated into a physical deterrent barrier and that is adapted to surveillance of the air space over the deterrent barrier.

It is often necessary to protect equipment and secure areas from unauthorized, unwanted and somtimes hostile personnel and vehicles. Such protection conventionally includes fencing that encompasses the area or equipment to be protected. Intruder detection systems are also used in conjunction with fences or other physical deterrent barriers to enable responsible personnel to monitor the premises and to take appropriate action in response to detected intrusions. One well known state-of-the-art intrusion detection system utilizes radar ranging principles. This type of system is implemented by means of a leaky transmission line that encompasses the secure area. Violation by an intruder of the r.f. field that radiates from the leaky transmission line results in reflections which can be processed in a known manner to identify and locate any given intrusion event.

Although both physicai deterrent barriers and state-of-the-art intruder detection systems are reasonably effective individually they have never been fully integrated in order to improve efficiency and increase monitoring capability and protection of the secure area. Furthermore, the air space over the physical deterrent barrier in these systems has never been monitored. This unprotected area thus introduces a possible security breach. There currently exists, therefore, the need for secure area protection systems that provide physical deterrent barriers having integrated intruder sensors for monitoring the air space over the barrier. The present invention is directed toward satisfying that need. It is proposed that this be accomplished by providing an integrated physical barrier-monitor system that acts as both intruder deterrent and intruder detector. The detector comprehended by the invention utilizes the leaky transmission line radar ranging type of detection system in which the air space over the deterrent barrier is monitored through an upward looking corner reflector antenna.

SUMMARY OF THE INVENTION

The invention comprehends a secure area protection system in which a physical deterrent barrier is provided with an upward looking intruder detection sensor for monitoring intrusions in the air space over the barrier. The intruder detection sensor comprises a corner reflector antenna mounted on the top of and coextensive with the deterrent barrier. Its active element is a leaky transmission line that extends the length of the corner reflector antenna, radiates r.f. energy and carries reflections from intrusion events back to a receiver and processing circuits. The sensor of the invention is thus designed to operate in conjunction with leaky transmission line radar ranging type intrusion detection systems.

A preferred embodiment of the invention utilizes parallel barbed wire strands arranged in a V configuration on the top of a chain link fence as the corner reflector antenna element. This embodiment has the appearance of a conventional security fence giving no indication to intruders of the possibility of electronic monitoring of their activities.

It is a principal object of the invention to provide a new and improved secure area protection system.

It is another object of the invention to provide a physical deterrent barrier with an upward looking detection sensor for intruder detection systems of the leaky transmission line radar ranging type.

It is another object of the invention to provide a sensor for a leaky transmission line radar ranging type intruder detection system that is integrated with a physical deterrent barrier and that monitors the air space over the deterrent barrier.

It is another object of the invention to provide an integrated deterrent barrier—intruder detecting sensor that utilizes a barbed wire topped chain link fence and has no appearance of electronic surveillance capability.

These together with other objects, features and advantages of the invention will become more readily apparent from the following detailed description when taken in conjunction with the illustrative embodiments in the accompanying drawings wherein like elements are given like reference numerals throughout.

DETAILED DESCRIPTION OF THE PREFERRED EMBODIMENT

The Upward Looking Intruder Detection System of the invention provides means for detecting and locating low altitude intrusions across the perimeter of a fenced installation by humans, by manned vehicles, by unmanned vehicles, or by any combination of the three types.

The invention envisages a r.f. corner reflector type of antenna (two flat reflectors intersecting at an angle or corner) with the aperture facing upward into the sky, and the corner fastened to or a part of the top of the fence or physical barrier. A leaky coaxial cable(s), which runs the entire length of the corner reflector, energizes the corner reflector and also receives reflections caused by an intrusion across the air space illuminated by the radiated beam of the corner reflector. The return signal is processed by the appropriate electronic circuitry and the alarm given.

Figure 1:
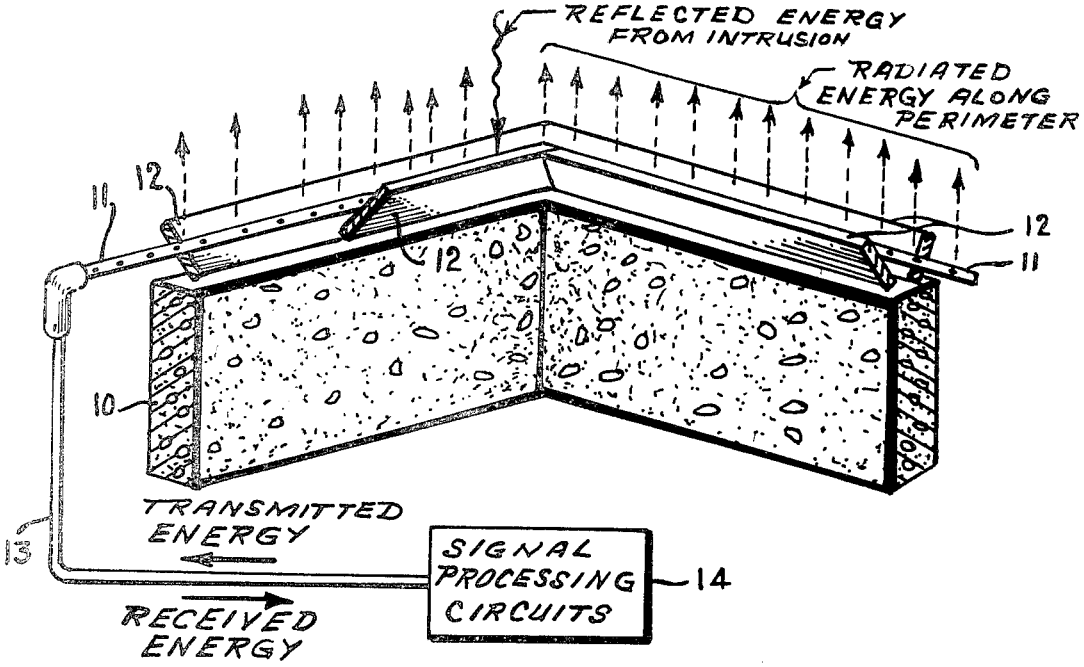
FIG. 1 is an isometric illustration of a physical deterrent barrier having a corner reflector antenna sensor as comprehended by one presently preferred embodiment of the invention.
Figure 2:
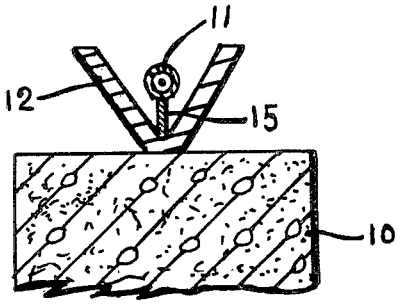
FIG. 2 illustrates, in cross section, the corner reflector antenna sensor of FIG. 1.

Referring now to FIGS. 1 and 2 the invention consists of r.f. corner reflector 12 having its aperture facing upward into the sky and its apex fastened to or a part of the perimeter physical deterrent barrier 10 and leaky coaxial cable 11 which runs the entire length of the corner reflector 12 and feeds r.f. energy to the corner reflector along its entire length. Reflections caused by intrusions across the air space illuminated by the radiated energy from the corner reflector are received and the leaky coaxial cable 11 conducts the reflections back to the appropriate electronic signal processing circuitry 14 for signal processing and intrusion event signalling and display. Corner reflector antenna 12 can be fabricated of flat reflectors such as sheets of electronically conductive material. Leaky coaxial cable 11 can be any suitable leaky transmission line and it is positioned an appropriate distance from the corner reflector antenna by means of stand off member 15.

Figure 3:
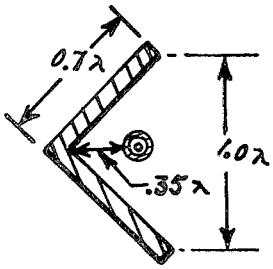
FIG. 3 PRIOR ART
FIGS. 3 and 4 are prior art sketches illustrating practical dimensions for square corner reflector antennas.
Figure 4:
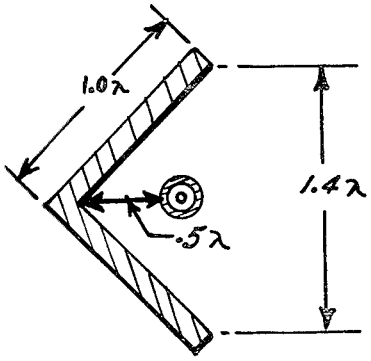
FIG. 4 PRIOR ART

Practical dimensions for square corner reflector antennas are well documented in the technical literature for antennas. By way of example, FIGS. 3 and 4 shows typical dimensions taken from pages 328–336 of the textbook *Reflector Type Antennas* by J. D. Kram, published by McGraw Hill, 1950. The operating frequency can be selected accordingly. In the illustration of FIG. 3 $\lambda$ is the system operating wavelength.

An alternative embodiment of the Look-Up intruder detection system of the invention provides means for detecting low altitude intrusions over a perimeter bounded by a chain link fence which is topped by "V" arms that hold and support stranded barbed wire.

The invention envisages using the V channel formed by the "V arms" and the "barbed wire" as the corner reflector antenna. At the proper frequency(s) the sides, formed by the barbed wire and the space between, act like metal plates to r.f. energy in the channel. Radio frequency energy is supplied to the length of the channel by a leaky coaxial cable which acts as a distributed energy source in the manner described above. As in the above-described embodiment this r.f. energy radiates into the space above the fence thereby forming a continuous antenna beam along the entire fence perimeter. An intrusion through this antenna beam causes reflections back into the channel. Since the leaky coaxial cable is a reciprocal device which can transmit and/or receive energy, the reflections are received and then conducted to the signal processing circuitry. The alarm is then sounded.

Figure 5:
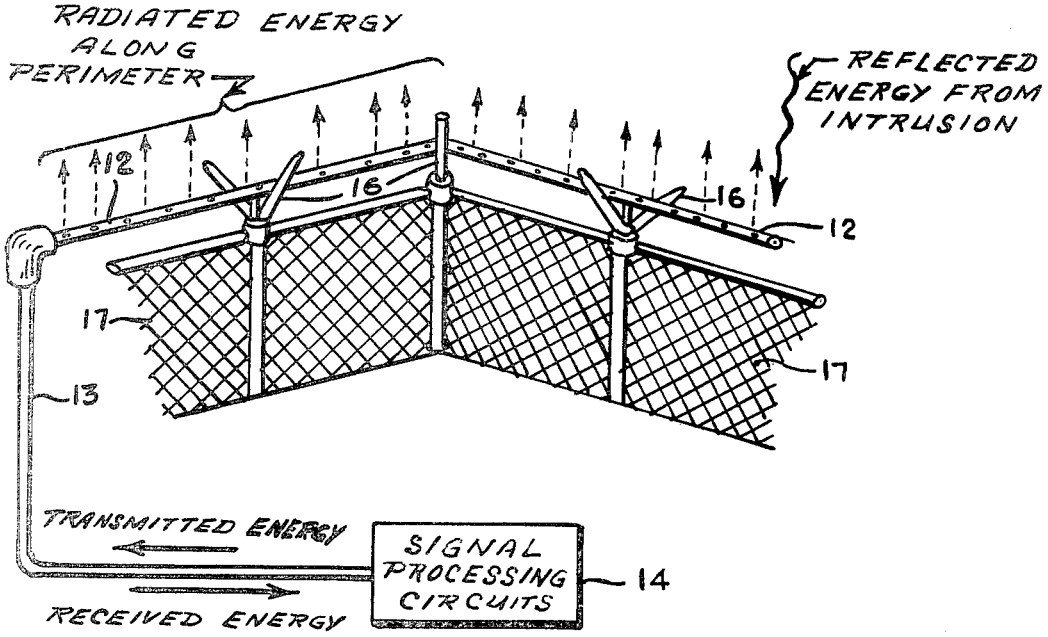
FIG. 5 is an isometric illustration of a physical deterrent barrier having a corner reflector antenna as comprehended by an alternative embodiment of the invention.

Referring now to FIG. 5, the invention uses the V channel formed by the "V" arms 16 that hold and support the barbed wire together with the "barbed wire" itself (not shown for clarity of illustration) as a corner reflector type of antenna.

Figure 6:
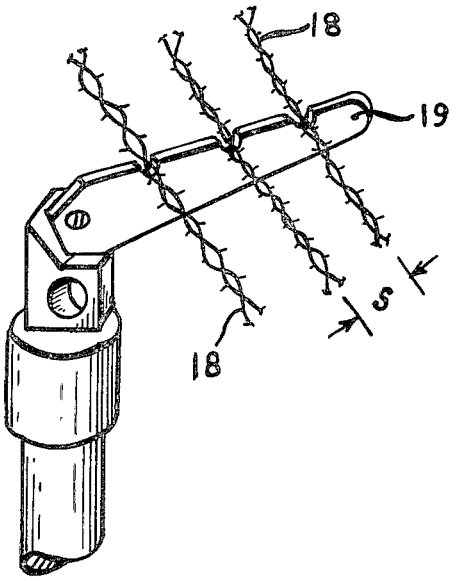
FIGS. 6, 7 and 8 illustrate details of the corner reflector antenna of FIG. 5.
Figure 7:
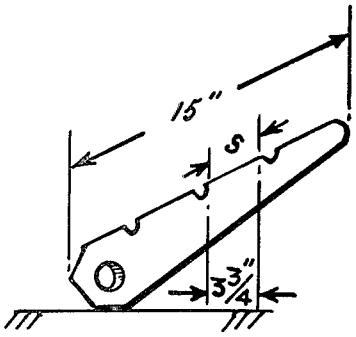

At the proper frequency(s) the sides of the channel, formed by the barbed wire and the space between, act like metal plates to r.f. energy in the channel. FIG. 6 shows one typical metal support arm 19 that is commonly used, holding three strands of barbed wire 18. Electromagnetic theory states and practice shows that if the spacing between parallel metal rods is about a tenth of a wavelength or less, the rods reflect any r.f. energy that strikes them. In effect, the rods (or in the present example the barbed wire strands) act like a solid metal reflector. FIG. 7 shows the approximate dimensions of the arm 19 and the spacing between the barbed wire. By applying the spacing criteria of a tenth of a wavelength, the upper bound of the operating frequency can be calculated:

Give $$s=3.75''=0.1\lambda$$

$$\lambda=37.50'' \text{ and } F=320 \text{ MHz}$$

The arm 19 that is shown has been notched to accept three strands of barbed wire. However, the number of notches could be doubled, if necessary, and six strands of barbed wire accepted. In that instance, the upper bound of the operating frequency would be about 640 MHz.

Figure 8:
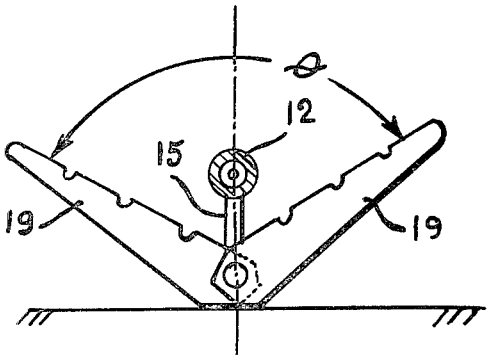

As is noted in FIG. 7, the angle of the arms 19 can be adjusted somewhat. Typically, the fully channel angle "$\phi$" (see FIG. 8) is between 85 and 100 degrees, well within the range of practical corner reflector antenna design described in the referenced text, *Antennas* by J. Kraus, p 328–336.

The leaky coaxial cable 12 feeds the V-channel along its entire length (see FIG. 3) and this energy is radiated by the corner reflector type of antenna. The leaky coaxial cable also receives reflections caused by an air borne intrusion through the illuminated space above the fence, and conducts these received signals to the signal processing equipment.

Figure 9:
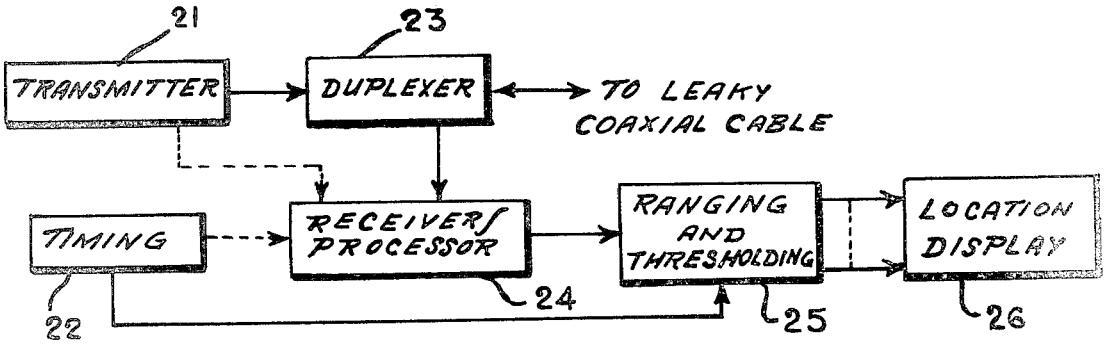
FIG. 9 is a block diagram of the signal transmitting, receiving and processing circuits for the type of intrusion detection system to which the invention pertains.

FIG. 9 is a block diagram of the electronic hardware and signal processing functions associated with the invention. This comprises a transmitter 21, duplexer 23, receiver/processor 24, ranging and thresholding circuits 25, timing circuit 22 and location display 26. These circuits are conventional and commonly used in conjunction with leaky transmission line radar ranging type intruder detection systems.

While the invention has been described in terms of its preferred embodiments it is understood that the words which have been used are words of description rather than words of limitation and that changes within the purview of the appended claims may be made without departing from the scope and spirit of the invention in its broader aspects.

What is claimed is:

1. In an intruder detection system utilizing leaky transmission line sensor means and having a transmitter for transmitting r.f. signals therealong and including a receiver and processing circuits for receiving and processing reflected r.f. signals resulting from intruder violations of said sensor means, the improvement residing in an intruder deterrent barrier and upward looking intruder detection sensor, said deterrent barrier and upward looking intruder detection sensor comprising:

a physical intrusion deterrent barrier, an r.f. corner reflector antenna comprised of a multiplicity of strands of barbed wire and having an aperture, said corner reflector being disposed on the top surface of and coextensive with said barrier, the aperture of said corner reflector antenna being directed upwards, and a leaky transmission line within and extending along the length of said corner reflector antenna and providing an r.f. signal therefor, said leaky transmission line being operatively connected into said intruder detection system.

2. A deterrent barrier and upward looking intruder detection sensor as defined in claim 1 wherein said strands of barbed wire are spaced at a distance not greater than 0.1λ, λ being the operating wavelength of said intruder detection system.

3. A deterrent barrier and upward looking intruder detection sensor as defined in claim 2 wherein said parallel strands of barbed wire define a cover reflector antenna having a full channel angle of not less than 85° and not more than 100°.

4. A deterrent barrier and upward looking intruder detection sensor as defined in claim 2 wherein said physical intrusion deterrent barrier comprises a chain link fence, said parallel strands of barbed wire are strung on upwardly oriented V-arm supports connected to the top of said chain link fence, and said leaky transmission line comprises a leaky coaxial cable.

5. A deterrent barrier and upward looking intruder detection sensor as defined in claim 4 wherein said V-arm supports are adjustable to provide corner reflector antenna angle adjustments between 85° and 100°.

* * * * *